United States Patent [19]

Yamashita

[11] 4,383,498

[45] May 17, 1983

[54] APPARATUS FOR APPLYING MAGNETIC TONER TO A MAGNETIC TRANSPORT ROLL

[75] Inventor: Keitaro Yamashita, Saitama, Japan

[73] Assignee: Hitachi Metals, Ltd., Tokyo, Japan

[21] Appl. No.: 188,528

[22] Filed: Sep. 18, 1980

Related U.S. Application Data

[63] Continuation-in-part of Ser. No. 20,322, Mar. 14, 1979, abandoned.

[51] Int. Cl.[3] ..... G03G 15/00

[52] U.S. Cl. ..... 118/657; 355/3 DD

[58] Field of Search ..... 118/657, 658; 355/3 DD

[56] References Cited

U.S. PATENT DOCUMENTS 3,941,469 3/1976 Okamoto ..... 355/3 DD 4,254,202 3/1981 Matsumoto et al. ..... 430/120

FOREIGN PATENT DOCUMENTS 1493280 11/1977 United Kingdom .

*Primary Examiner*—Bernard D. Pianalto

*Attorney, Agent, or Firm*—Finnegan, Henderson, Farabow, Garrett & Dunner

[57] ABSTRACT

This invention relates to apparatus for developing electrostatic latent images, and, more particularly, to apparatus and method for controlling the feed of magnetic toner between a toner supply hopper and a magnetic transport roll.

10 Claims, 7 Drawing Figures

Fig. 1
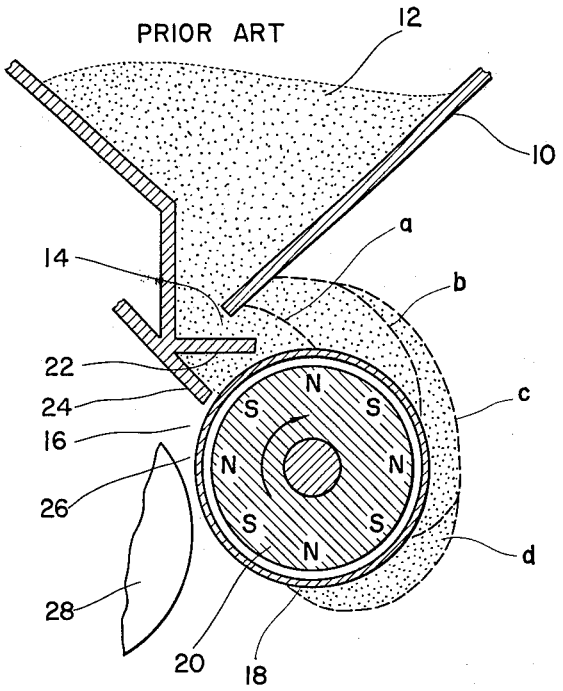
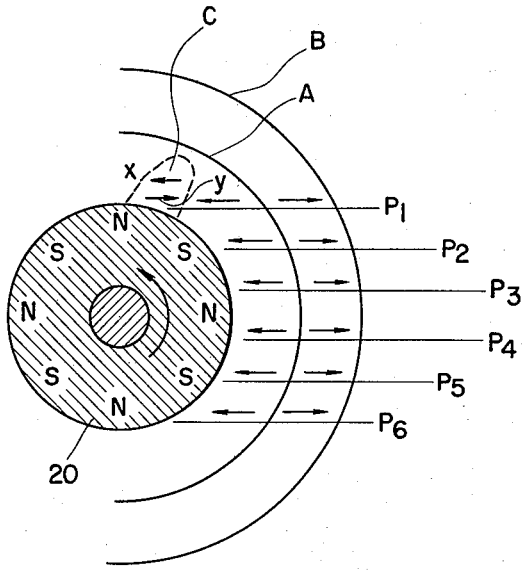
Fig. 2
Fig. 3
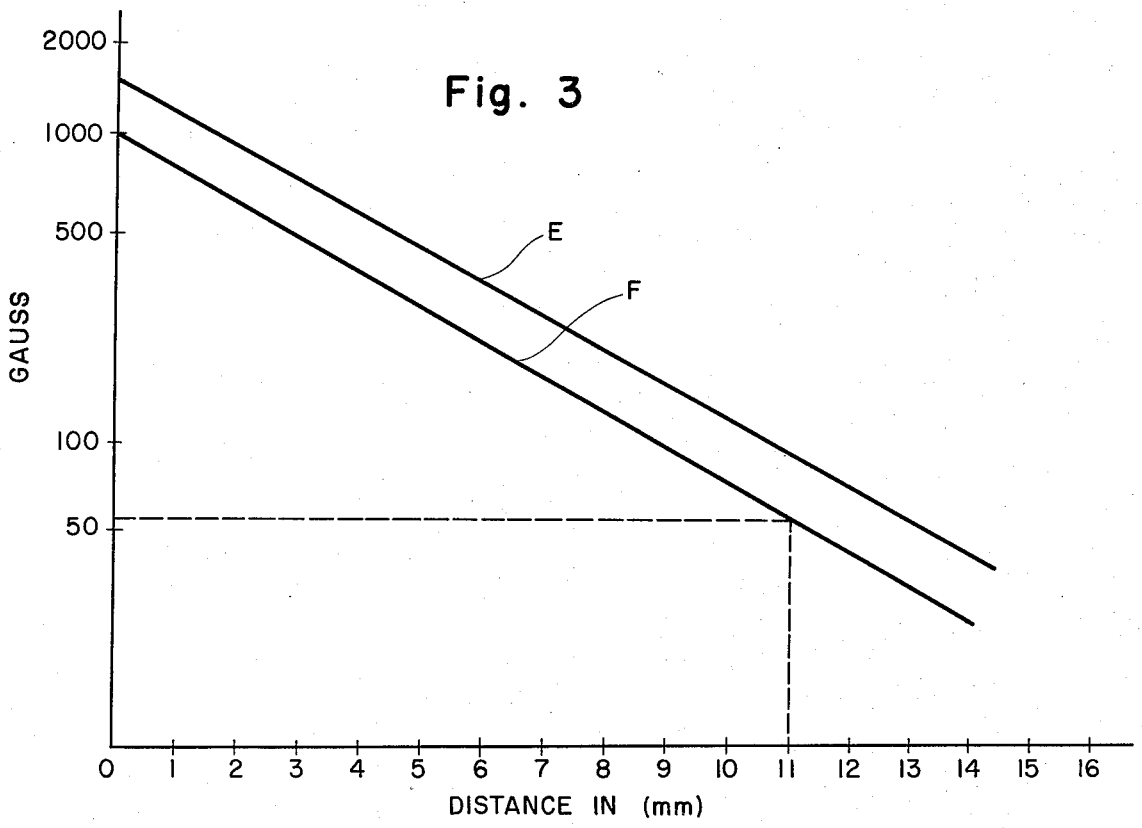

APPARATUS FOR APPLYING MAGNETIC TONER TO A MAGNETIC TRANSPORT ROLL

This application is a continuation-in-part of Ser. No. 06/020322, Mar. 14, 1979, now abandoned.

BACKGROUND OF THE INVENTION

It is now well-known to convey magnetic toner from a toner supply hopper to a latent image development zone of an electrostatic copying machine by a magnetic transport roll.

Such a roll includes a non-magnetic shell or sleeve within which rotates a magnet roll. One form of such a magnet roll includes a plurality of elongated magnets of alternating polarity spaced about the circumference of the roll, parallel to the axis. As the magnet roll rotates in one direction, the bipolar magnetic toner rolls along the surface of the shell in the other direction under the magnetic influence of the constantly alternating polarities. Such a magnetic transport roll is shown in U.S. Pat. No. 3,455,276 granted to G. R. Anderson on July 15, 1969.

Conventional apparatus for conveying magnetic toner from a supply in a hopper to a magnetic transport roll is shown in FIG. 1, including a toner supply hopper 10 for holding a supply of magnetic toner 12. The magnetic toner 12 is fed through a discharge port 14 onto the surface of a magnetic transport roll, shown generally as 16.

The magnetic transport roll 16 includes a non-magnetic shell 18 within which is positioned a rotatable magnet roll 20 having elongated magnets of alternating polarities in its circumference. A feed path is provided by a control plate 22 from which it is attracted to the surface of the non-magnetic shell 18 by the magnetic flux density of the magnet roll 20.

Assuming that the magnet is rotated clockwise and the cylindrical shell 18 is fixed, the magnetic toner is drawn out from the discharge port 14 and then lies on the cylindrical shell 18. The magnetic toner 12 on the cylindrical shell 18 moves in a counter-clockwise direction. A doctor blade 24 determines the thickness of the layer of toner 12 being conveyed by the transport roll 16 to a development zone 26 where the toner is brought into contact with latent electrostatic images on a drum 28.

Magnetic toner 12 which has not adhered to the latent images in the apparatus depicted in FIG. 1 continues to advance in counterclockwise direction around the surface of the shell 18 under the influence of the magnet roll 20. A problem then arises as the unused toner accumulates at the discharge port 14 and the accumulation backs up against the counterclockwise flow of the toner.

FIG. 1 illustrates an example of such accumulation. At the start of operation an adequate amount of a toner 12 is drawn out of the toner supply hopper 10 onto the shell 18. Upon high speed rotation of the magnet roll 20 within 5 minutes the accumulation grows to the size b, within 10 minutes to the size c, and within 15 minutes to the size d. This phenomenon, not only results in a significant degradation in the quality of the image by toner backing up into the development zone 26, but also contaminates the adjacent equipment with excess toner escaping from the attraction zone of the magnet roll 20.

SHORT SUMMARY OF THE INVENTION

It is therefore the principal object of this invention to provide apparatus and method to automatically interrupt the feeding of magnetic toner from the discharge port of a toner supply hopper as soon as an accumulation of toner near the discharge port exceeds a predetermined amount.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, the apparatus for supplying the magnetic toner has a structure wherein a non-magnetic plate for guiding a toner from a toner discharge port provided at the lower portion of a toner hopper is arranged at the vicinity of tangential point in parallel to the tangential plane of cylindrical shell of a magnet roll so as to force the magnetic toner to move rightwards and leftwards at the terminal portion of the plate by the rotation of the magnet roll. The toner is then conveyed through the gap between the non-magnetic plate and shell, the plate acting as a doctor blade.

Because of such a structure, the amount of magnetic toner accumulated on the non-magnetic guide plate attached to the toner hopper and on the shell is automatically controlled and kept substantially constant.

In the present invention, it is also desirable to arrange the guide plate tangentially to the shell.

It is also preferable to arrange the discharge port within an attractive area in the vicinity of the shell, the terminal portion of the plate forming a doctor blade for determining the depth of the toner applied to the shell along the non-magnetic surface.

The invention also includes a method for controlling the feeding of magnetic toner along a feed path in a process for supplying magnetic toner from a discharge port of a toner supply hopper to the surface of a non-magnetic cylindrical shell within which a magnet roll is rotatable, the magnet roll having on its surface a plurality of elongated magnets, parallel to the axis of the roll and alternating in polarity, the feed path guiding toner from the discharge port onto the surface of the shell, the method comprising:

forming said feed path of non-magnetic material, positioning said feed path substantially perpendicular to a plane through the axis of said magnet roll, and controlling the amount of toner on said feed path by attracting toner to said shell under the magnetic attraction of said magnet up to the limit of the distance of said magnetic attraction, and impeding the discharge of toner from said discharge port by moving toner accumulating on said feed path beyond said distance limit toward said discharge port by rotation of the magnetic toner under the alternating polarities of the rotating magnet.

Preferably the method also includes the step of setting the distance of the discharge port from the surface of the shell substantially at the distance limit of attracting the toner toward the shell by the magnet roll and positioning the feed path substantially tangential to the surface of the shell.

The accompanying drawings, which are incorporated in and constitute a part of this specification, illustrate one embodiment of the invention, and together with the description, serve to explain the principles of the invention.

BRIEF DESCRIPTION OF THE DRAWING

FIG. 1 is a schematic drawing illustrating an example of conventional apparatus for supplying magnetic toner from a hopper to a magnetic transport roll.

FIG. 2 is a schematic drawing illustrating the principle on which the present invention is based.

FIG. 3 is a graph illustrating the relation of the distance between the surface of the magnet roll and the magnetic flux density for two known magnet rolls.

DESCRIPTION OF THE PREFERRED EMBODIMENT

Figure 4:
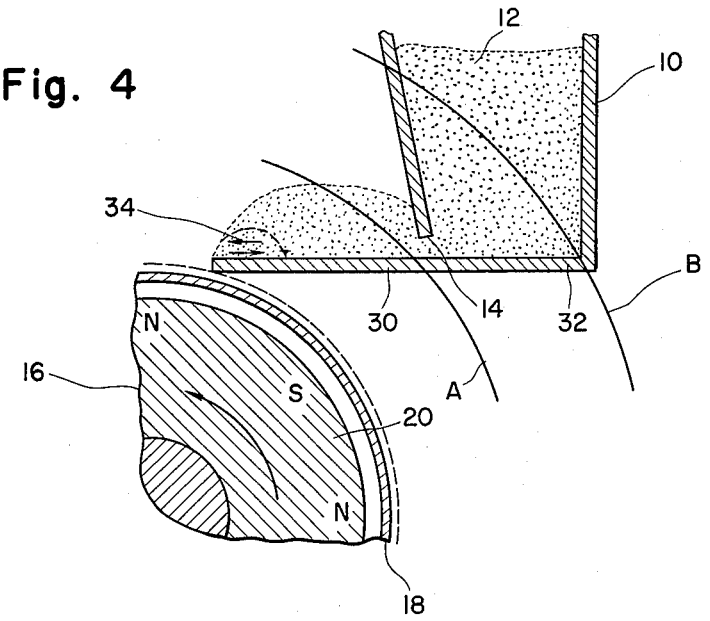
FIG. 4 is a schematic drawing showing a partial cross-section of the embodiment of the magnetic toner control apparatus of the invention.

As stated previously, FIG. 1 shows one example of conventional apparatus for supplying magnetic toner from a supply hopper to a development area for latent images on an image-bearing surface. Magnetic toner 12 is fed through discharge port 14 of toner supply hopper 10 along a guide plate 22, onto the surface of the non-magnetic shell 18 of the magnetic transport roll 16 under the magnetic attraction of magnet roll 20.

Doctor blade 24 determines the thickness of the layer (not shown) of toner 12 being conveyed on the surface of the shell 18 to the development zone 26 where the toner is brought into contact with the latent electrostatic images on the surface of drum 28.

It was previously known that the rotation of a magnet roll, having magnets of alternating polarities positioned around its surface, causes bipolar toner particles on the surface of a non-magnetic shell surrounding the magnet roll to rotate, and therefore roll or tumble along the surface of the shell in the direction opposite to the direction of rotation of the magnet roll, in a phenomenon called curl movement.

FIG. 2 illustrates movement of magnetic toner around a rotating cylindrical magnet (magnet roll 20). In this observation, there was used HMT-601 magnetic toner prepared by Hitachi Metals, Ltd., comprising about 60% by weight of magnetic powder, and there was also employed a magnet roll having an outer diameter of 29.3 mm, the peripheral surface of which is magnetized symmetrically so that N- and S-poles of 8 magnetic poles are arranged alternatively around the roll. The magnet roll was not attached to a non-magnetic cylindrical shell around the outer periphery. There had been employed at first an anisotropic barium ferrite permanent magnet having surface magnetic flux density of 1,650 gauss on magnetic poles; then an anisotropic barium ferrite permanent magnet having surface magnetic flux density of 1,080 gauss on magnetic poles was used.

The anisotropic barium farrite permanent magnet was rotated counterclockwise at 450r.p.m. and an aluminum plate was made to the permanent magnet in the horizontal direction. Then the movement of magnetic toner on the aluminum plate was for different horizontal plate positions in the vertical direction observed.

The position of magnetic toner on the aluminum plate was found to move toward the permanent magnet as shown by arrows by the attraction of magnetic toner due to the magnet when the plate is within the area A surrounded by the circle A. On the horizontal plane spaced apart 1.5 mm downwards from a horizontal plane passing through the axis of magnet, i.e. about P4 in FIG. 2 the toner moves in the direction to the magnet along the surface of the aluminum plate because of the force of gravity. For plate locations below this horizontal plane, the toner jumps up from the aluminum plate to move in the direction to the magnet. The bondary defined by the horizontal plane apart 1.5 mm downwards from the axis appears to be caused by the fact that within the area above such a horizontal plane, the vertical component of attraction force caused by the magnet is less than the force of gravity on the toner.

Applicant has discovered a phenomenon which occurs in the movement of the toner when the plate is positioned in a certain location.

Immediately before the horizontal aluminum plate mounting the toner thereon which is contacted with the magnet leftwards in FIG. 2, and moved upwards along the periphery of the magnet has arrived at the apex (see P1 in FIG. 2), the toner attempts to move both in the direction towards the magnet, i.e., leftwards in this case, within the area C near the tip of the plate and, because the magnet is rotated at the same time, and the subsequent magnetic pole approaches forwards i.e. leftwards near the apex of magnet 20, the toner also attempts to move backwards (rightwards, y-direction) in this same area C. The toner moves leftwards (x-direction) with the movement of magnetic pole, but due to the friction between the toner and aluminum plate, the movement of toner lags that of magnetic pole to be resulted in the approaching of the subsequent magnetic pole. Hence the toner vibrates on the aluminum plate in the area C in the vicinity of the tip of the plate, causing a dam-like accumulation of toner. Some of the toner is, of course, transferred to the magnet past the dam, such that a net transfer of toner to the magnet from the guide plate occurs.

There will be now disclosed motion of the toner when the aluminium plate mounting the toner thereon is pulled apart from the magnet to the outside of the area A into area B which is shown between the circles A and B on FIG. 2. Within the area B, the magnetic attraction force of toner is not sufficiently strong to bring the toner to the magnet but as the toner is subjected to the rotating magnetic field, rotation in the direction opposite to that of magnet roll is induced to the toner such that the toner rolls are tumbles away from the magnet.

The area B between the circles A and B will be defined hereinafter as "rotational plane motion area", the area C as "vibration motion area" and the area A between circle A and the magnet roll surface as "attractive area" in FIG. 2.

The present invention applies the vibration of toner in the vicinity of the apex of magnet roll in FIG. 2 to apparatus for supplying the magnetic toner.

FIG. 3 shows the relationship between the magnetic flux density on the magnet roll and the distance from the surface of the magnet roll. The lines E and F correspond to an anisotropic barium ferrite magnet and an isotropic barium ferrite magnet, respectively. The line E is $B_x = 1{,}640e^{-0.26x}$ and the line F is $B_x = 1{,}080e^{-0.26x}$. The circle A of FIG. 2 develops at the distance of about 11 mm from the roll surface when an isotropic magnet used. The magnetic flux density on the circle A is about 62 gauss. The circle B of FIG. 2 develops at the distance of about 18.5 mm from the roll surface and the magnetic flux density on the circle B is about 8.8 gauss.

When an anisotropic magnet is used, the circle A is at the distance of about 13 mm from the roll surface and the magnetic flux density on the circle A is about 56 gauss. The circle B is at the distance of about 20 mm from the roll surface and the magnetic flux density on the circle B is about 9 gauss.

The position of the rotational plane motion area and the attractive area does not depend on kind of permanent magnet but on the strength of magnetic flux density. The circle A is at the position of magnetic flux density 50 to 80 gauss and the circle B is at the position of magnetic flux density 6 to 10 gauss.

FIG. 4 is a cross-section of an example of the apparatus of the present invention. In the figure, parts similar to shown in FIG. 1 are attached the same numerals. The numeral 30 is a guide plate extending from the bottom of a toner supply hopper 10 to supply magnetic toner to the shell 18. The guide plate 30 functions as a doctor plate. The guide plate 30 is positioned on the tangential line of a shell 18 and the surface of the plate opposite to a surface facing the shell holds magnetic toner.

A discharge port 14 of the hopper 10 is positioned adjacent the circle A. The gap width of the discharge port 14 may be designed according to flowability of the magnetic toner, preferable gap width is about 2 mm. The right end of the guide plate is located inside the circle B.

When the shell 18 is fixed and the magnet roll 20 is rotated counterclockwise, the magnetic toner stored in the hopper is conveyed onto the shell 18 through the discharge port 14. After the thickness of toner layer on the shell is metered by the doctor gap between the edge of the guide plate and the shell surface, the toner is transported on the shell clockwise. After developing latent electrostatic images on a drum, the excess toner returns onto the guide plate 30. As the result, a toner accumulation grows on the left end of the guide plate.

According to the increase of the toner accumulation, the rightward pushing force and the gravity of the toner take place on the accumulated toner to retract the toner supply from the discharge port 14. When the accumulation decreases because of consumption of toner on the development, the accumulation moves leftward to allow new toner to be supplied through the discharge port. As this manner, the supply of toner to the shell is held continuously.

The portion 34 of the toner accumulation on the end of the guide plate vibrates rightward and leftward because of the rotation of the magnet roll 20 as described in the explanation of FIG. 2.

Unlike the conventional apparatus of FIG. 1, in the developing apparatus of FIG. 4, the toner supply from the discharge port is self-controlled by the toner accumulation at the so-called, vibration motion areas to eliminate the growth of the accumulation and to keep constant the amount of the toner supply.

It is preferable that the discharge port is within 5 mm from the circle line A, and more preferably within 3 mm from the line A.

Figure 5:
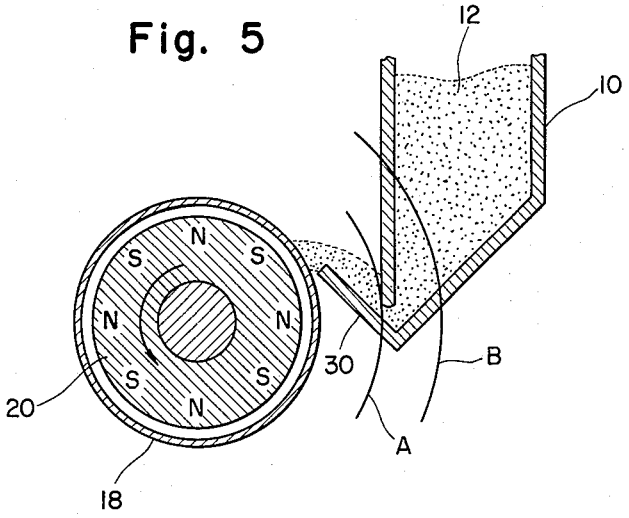
FIGS. 5, 6 and 7 are schematic drawings similar to FIG. 4 but showing other embodiments of the invention.
Figure 6:
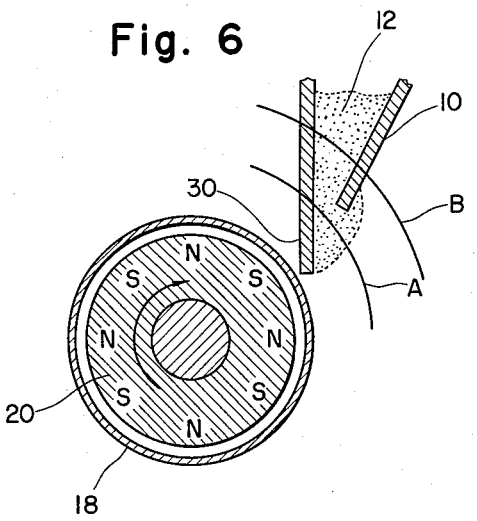
Figure 7:
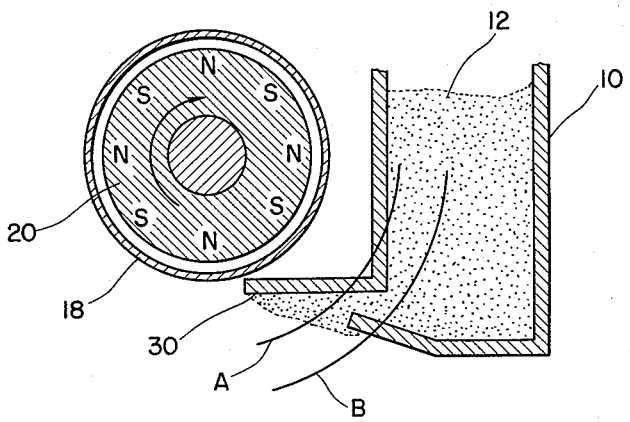

As shown in FIG. 4, the bottom wall 32 is situated horizontally. But, such arrangement of the toner hopper 10 is not necessary as shown in FIGS. 5 to 7.

Upon rotating the magnet roll 20 counter-clockwise, while fixing the cylindrical shell 18, the magnetic toner 12 falling from the plate 30 moves clockwise on the cylindrical shell to the development area. Then the toner develops the electrostatic latent images on the drum 28 (FIG. 1) and the excess magnetic toner continues to move clockwise around the shell 18 and returns to the non-magnetic surface of the plate 30. As the result, a toner accumulation begins to form on the surface of the plate 30 extending along the plate toward the discharge port 14.

As the accumulation on the plate 30 grows and extends toward the discharge port 14, the top of the accumulation exceeds the distance limit A, i.e., is no longer attracted toward the magnet roll 20, but instead rolls toward the discharge port, thereby impeding the discharge of toner through the port.

In this state, the magnetic toner 12 on the plate 30 nearest the magnet roll 20 rotates under the alternating polarities of the magnet roll 20, but is nevertheless attracted onto the surface of the shell 18 to keep a steady feed supply of toner on the shell. This action tends to reduce the accumulation of magnetic toner 12 on the plate. If the discharge port 14 is impeded by the movement of toner away from the magnet roll 20, the accumulation of toner on the plate is reduced, and toner is once again discharged from the port 14 onto the plate 30 for attraction to the magnet roll 20.

An automatic control of the amount of magnetic toner is thus established on the non-magnetic plate 30, wherein the flow of toner from the discharge plate is either permitted or impeded, respectively, by the reduction of the accumulation of toner on the plate 30, or the increase of accumulation of toner on the plate 30. This control is effected by the location of the discharge port 14 substantially at the distance limit A for taking advantage of the phenomenon of curl movement for impeding the flow of toner toward the discharge port 14, when the accumulation of toner on the plate exceeds a predetermined amount.

FIGS. 5, 6 and 7 show other embodiments according to the invention wherein the discharge port is positioned substantially at the limit distance A for controlling the accumulation of toner by use of the phenomenon of curl movement. In each of these embodiments the projection of the plate 30 is substantially tangent to the shell 18.

In FIG. 5 the rearward wall of the toner supply hopper is slanted for sliding the toner toward the discharge port 14 and the non-magnetic plate 30 is slanted slightly upwardly.

In the embodiment of FIG. 6 the plate 30 is positioned vertically and the magnet roll is rotated clockwise. In the embodiment of FIG. 7, the plate 30 is disposed horizontally but positioned to be tangent to the bottom of the shell 18 and the magnet roll 20 rotates clockwise, the toner likewise feeding through the gap formed by the plate 30 and the surface of the shell 18.

Since the operation of the embodiments of FIGS. 5, 6 and 7, is the same as those in the embodiment shown in FIG. 4, no further explanation needs to be made.

In a conventional structure as shown in FIG. 1, the toner fed to the shell 20 through the discharge port 14 is regulated or metered by means of the doctor blade 24. In order for the doctor blade 24 to function effectively, it is necessary to provide a smaller gap between the doctor blade and the shell than the distance between the control plate 22 and the shell 18. The toner passed through the doctor gap is used partly for developing a latent image and the remainder is returned to the toner supply by the rotation of magnet roll to form the toner accumulation. The control plate and the doctor blade are buried under the accumulated toner. A fresh toner passing through the accumulated toner tends to be supplied on the shell to grow the toner accumulation.

On the contrary, because of the above-mentioned structure according to the present invention, the toner fed from the toner discharge port positioned at the lower portion of toner hopper to the surface of the non-magnetic guide plate is rotated and vibrated in the vicinity of the tip of the guide plate by the effect of rotating magnetic field due to the magnet roll.

If there is no or less than a critical amount of toner on the shell, the magnetic toner is supplied to the shell from the hopper and conveyed clockwise on the shell by the rotation of magnet roll which is rotated counterclockwise.

The amount of magnetic toner is metered or regulated by means of the lower end of the guide plate acting as a doctor blade. However, since the amount of toner conveyed clockwise on the shell usually is larger than that consumed for developing latent images, the toner is accumulated gradually at the tip of guide plate to form a reservoir.

Such formation of toner accumulation stops the supply of fresh toner from the toner hopper to the shell due to the toner present within the vibration motion area. In other words, since the toner within the vibration motion area is forced to the discharge port by the toner accumulation, the latter acts as if a dam were formed on the guide plate. As a result, the accumulated toner passes through the gap between the lower end of guide plate and shell to be conveyed to the developing zone. When the toner accumulation is decreased, fresh toner is supplied from the toner hopper along the guide plate.

The toner is thus supplied stably by balancing the formation of toner accumulation and reduction of toner accumulation in such a manner.

It is thus essential in the present invention that the tip of the toner guide plate acts as a doctor blade.

Furthermore, the movement of toner can be sufficiently utilized within the vibration motion area by arranging the guide plate tangentially to the shell, i.e., so that the extension surface of guide plate is substantially tangential to the shell.

The following effect is achieved by disposing the discharge port of the toner hopper within the rotational plane motion area i.e. between circles A and B-FIG. 2:

Within the discharge port of toner hopper, the weight of toner in the hopper imposes a force so that the toner is always ready for the supply of toner through the port. By the provision of toner hopper within this area, the toner is not attracted to the magnet roll but subjected to the rotary motion, so that the effect of downward gravity can be reduced.

As apparent from the foregoing descriptions, the amount of the magnetic toner drawn out from the magnetic toner discharge port in the toner hopper can automatically be controlled according to the present invention. Thus, it is intended that the present invention cover the modifications and variations of this invention provided that they come within the scope of the appended claims.

What is claimed is:

1. In apparatus for supplying magnetic toner to an image-developing zone of a copying machine including a non-magnetic cylindrical shell, a magnet roll rotatable within the shell, the magnet roll including on its surface a plurality of elongated magnets parallel to the axis of the roll and alternating in polarity, and a hopper for holding a supply of lower portion, the improvement comprising:

a non-magnetic member having a plane surface for guiding toner from said discharge port to the vicinity of the surface of the shell, said member being substantially tangential to the surface of the cylindrical shell, said member having an end portion in the vicinity of said shell and said end portion forming a doctor gap with said shell for determining the depth of toner supplied to said shell from said surface, wherein said magnetic toner is supplied to a surface of said non-magnetic member from the toner discharge port of said hopper and the opposite surface to said surface of the non-magnetic member is facing to said non-magnetic cylindrical shell, said non-magnetic member being positioned upstream of the point of tangency relative to the direction of rotation of the magnet roll, and wherein said discharge port is positioned in the vicinity of a circular line which divides an area where magnetic toner particles tend to be attracted to the cylindrical shell by magnetic force and an area where magnetic toner particles tend to self-rotate by rotation of said magnet roll.

2. The improvement of claim 1, wherein the distance between said magnet roll and said discharge port along said surface is between about 11 and 13 millimeters.

3. The improvement of claim 1, wherein said non-magnetic member is integral with a wall of said hopper.

4. The improvement of claim 1 or 3, wherein said plate is horizontal.

5. The improvement of claim 1, wherein the magnetic flux density on said non-magnetic surface at said discharge port is between about 50 and 80 gauss.

6. The improvement of claim 1 wherein said discharge port is located within about 5 mm of said circular line.

7. The improvement of claim 6 wherein said discharge port is located within about 3 mm of said circular line.

8. The improvement of claim 1 wherein said doctor gap between said end portion of said non-magnetic member and the non-magnetic shell is about 2 mm.

9. In apparatus for supplying magnetic toner to an image-developing zone of a copying machine including a non-magnetic cylindrical shell, a magnet roll rotatable within the shell, the magnet roll including on its surface a plurality of elongated magnets parallel to the axis of the roll and alternating in polarity; a hopper for holding a supply of magnetic toner, the hopper having a toner discharge port at its lower portion; and a non-magnetic guide plate for transporting toner from the discharge port to the surface of the non-magnetic shell under the influence of the magnets, the improvement comprising:

means for forming a dam-like accumulation of toner on the guide plate for regulating the amount of toner transported from the discharge port to the shell, said dam-forming means including (a) the guide plate having a guide surface being aligned in a plane substantially tangent to the surface of the non-magnetic shell, the guide plate being positioned upstream of the point of tangency relative to the direction of rotation of the magnet roll;

(b) the discharge port being located to feed toner to said guide surface substantially at the limit of the distance from the magnet roll for attracting toner to the shell along said guide surface; and (c) said guide surface having a terminal part proximate the shell surface forming a doctor blade for determining the depth of toner applied to the shell surface.

10. The improvement as in claim 9 wherein (i) the discharge port is located between about 11 mm and 13 mm from the surface of the shell, (ii) the magnetic flux density at the discharge port is between about 50 gauss and 80 gauss, and (iii) the distance between the terminal part of said guide surface and the surface of the shell is about 2 mm.

* * * * *